US007152715B2

(12) United States Patent
Meyer

(10) Patent No.: US 7,152,715 B2
(45) Date of Patent: Dec. 26, 2006

(54) SNAP-FIT ELEVATOR HALL FIXTURE ASSEMBLIES

(75) Inventor: Gary Meyer, Middleton, TN (US)

(73) Assignee: Thyssen Elevator Capital Corp., Whittier, CA (US)

( * ) Notice: Subject to any disclaimer, the term of this patent is extended or adjusted under 35 U.S.C. 154(b) by 483 days.

(21) Appl. No.: 10/773,841

(22) Filed: Feb. 5, 2004

(65) Prior Publication Data

US 2005/0173201 A1 Aug. 11, 2005

(51) Int. Cl.
*B66B 1/34* (2006.01)

(52) U.S. Cl. ..... 187/391; 187/395

(58) Field of Classification Search ..... 187/391–397, 187/414, 313; 200/402, 405, 412, 417, 453; 362/234, 382, 240–247, 430, 454
See application file for complete search history.

(56) References Cited

U.S. PATENT DOCUMENTS 4,032,774 A 6/1977 Spicer
4,569,004 A 2/1986 Peterson
4,805,739 A * 2/1989 Lind et al. ..... 187/395
5,162,665 A * 11/1992 Troyen ..... 307/112
5,201,409 A 4/1993 Martin et al.
5,490,581 A * 2/1996 Warner et al. ..... 187/414
6,029,778 A * 2/2000 Lacarte Estallo ..... 187/414
6,142,648 A 11/2000 Logan et al.
6,227,335 B1 5/2001 Koeppe, Jr. et al.
6,598,711 B1 * 7/2003 Barmet ..... 187/395
2005/0224297 A1 * 10/2005 Felder et al. ..... 187/395

* cited by examiner

*Primary Examiner*—Jonathan Salata
(74) *Attorney, Agent, or Firm*—Frost Brown Todd LLC

(57) ABSTRACT

The present invention provides a snap-fit constructible elevator hall fixture assembly having a wall plate, a bezel, and a hall fixture. A snap-fit coupling attaches the wall plate to the bezel, and a snap-fit coupling attaches the hall fixture to the bezel. The fixture can be either a directional lantern indicator or a hall call push-button.

26 Claims, 14 Drawing Sheets

SNAP-FIT ELEVATOR HALL FIXTURE ASSEMBLIES

FIELD OF INVENTION

The present invention relates to an apparatus for providing easy-to-construct elevator hall fixture assemblies and, in particular, to elevator hall fixture assemblies having snap fit components.

BACKGROUND OF INVENTION

Elevator systems today have hall fixture assemblies that are typically located at each landing of a building serviced by an elevator. There are generally two types of hall fixture assemblies. Directional lantern indicator fixture assemblies are located in the hallway of each landing adjacent to the hatchway door of each elevator car and identify the direction the elevator is traveling when it reaches the landing by using one or more lights within the assembly. Hall call push-button fixture assemblies are also generally located in the hallway of each landing and allow passengers to call for an elevator as needed.

Hall fixture assemblies in the prior art are typically constructed of separate pieces that must be attached to one another with screws, nuts, bolts, and studs. Such attachment often requires hand labor, which is both inefficient and expensive. It would be desirable to provide a fixture that overcomes these problems.

SUMMARY OF INVENTION

The present invention provides a snap-fit constructible elevator hall fixture assembly whose assembly is both efficient and cost effective. According to one embodiment of the present invention, the fixture assembly comprises a wall plate, a bezel, and a hall fixture. A first snap-fit coupling attaches the wall plate to the bezel, and a second snap-fit coupling attaches the hall fixture to the bezel. The hall fixture can be either a directional lantern indicator or a hall call push-button. The hall fixture is disposed through an opening in the bezel.

In another embodiment according to the present invention, a snap-fit constructible elevator hall fixture assembly comprises a wall plate, a decorative faceplate, a bezel, a reflector, a lens, and a printed circuit board. This fixture is a directional lantern indicator. The wall plate has a hole in its top edge and a hole in its bottom edge which is attached to an electrical wall box. The wall plate itself has a front surface, a back surface, and a recessed portion on the front surface. The recessed portion has an opening, the perimeter of the opening on both the front and back surfaces having a plurality of grooves. The decorative faceplate has a faceplate opening and holes in the top and bottom edges of the faceplate. The faceplate's top edge hole is attached to the wall plate's top edge hole, and the faceplate's bottom edge hole is attached to the wall plate's bottom edge hole. The faceplate is mounted into the recessed portion of the wall plate for a secure fit. The bezel has an opening, a front surface, a back surface, and struts that vertically protrude from the back surface of the bezel. The front surface of the bezel has a plurality of protrusions on its perimeter which are engaged in the front surface grooves located in the recessed portion of the wall plate. The back surface of the bezel has a plurality of protrusions on its perimeter which are engaged in the back surface grooves located in the wall plate. The protrusions engaged in the grooves on both sides of the bezel and the wall plate form a snap-fit couple between the bezel and the wall plate. The reflector has an opening, vertically protruding legs, rib protrusions that vertically extend on the inner wall of the reflector, a rim, and sockets on the outer periphery of the reflector for receiving the bezel struts. These bezel struts are snap-fit coupled to the reflector sockets. The lens has a base and a body attached to the base. The body of the lens is engaged to the rib protrusions located on the reflector thus securing the lens to the reflector. The lens body extends through the bezel opening, the faceplate opening, and the reflector opening, and the lens base is fastened by the rim of the reflector. The printed circuit board has openings and superluminescent diodes for illuminating the lens. The openings on the printed circuit board are snap-fit coupled to the reflector legs.

According to another embodiment of the present invention, a snap-fit constructible elevator hall fixture assembly comprises a wall plate having a hole in its top edge and a hole in its bottom edge for attaching to an electrical wall box. The wall plate has a front surface, a back surface, and a recessed portion on the front surface. The recessed portion has an opening where the perimeter of the opening on both the front and back surfaces have a plurality of grooves. A decorative faceplate has a faceplate opening, a hole in the top edge of the faceplate, and a hole in the bottom edge of the faceplate. The top edge hole of the faceplate is attached to the top edge hole of the wall plate, and the bottom edge hole of the faceplate is attached to the bottom edge, hole of the wall plate. The faceplate is mounted into the recessed portion of the wall plate. An opening, a front surface, and a back surface are located on a bezel. The front surface of the bezel has a plurality of protrusions on its perimeter which are engaged in the front surface grooves in the recessed portion of the wall plate. The back surface of the bezel has a plurality of protrusions on its perimeter which are engaged in the back surface grooves in the recessed portion of the wall plate. The protrusions engaged in the grooves on both sides of the bezel and the wall plate form a snap-fit couple between the bezel and the wall plate. A push button has a body, struts extending from the body, a shoulder, and threads on the outer periphery of the body extending around the circumference of the body. This push button extends through the bezel opening and the faceplate opening. The shoulder of the push button abuts a portion of the faceplate surrounding the faceplate opening ensuring that the push button does not fall through the faceplate. To secure the push button to the faceplate, a locking nut having threads on its inner periphery has its threads twist-coupled to the threads on the push button until the nut abuts a portion of the back surface of the bezel. An electrical switch device is also part of the fixture and it has slots, an activation switch, and at least one light emitting diode. The slots are snap-fit coupled to the struts of the push button. When the push button is pressed onto the activation switch, the switch activates the light emitting diodes which in turn illuminates the push button.

These and other features, aspects, and advantages of the present invention will become better understood with regard to the following description, appended claims, and accompanying drawings.

DETAILED DESCRIPTION

Figure 1:
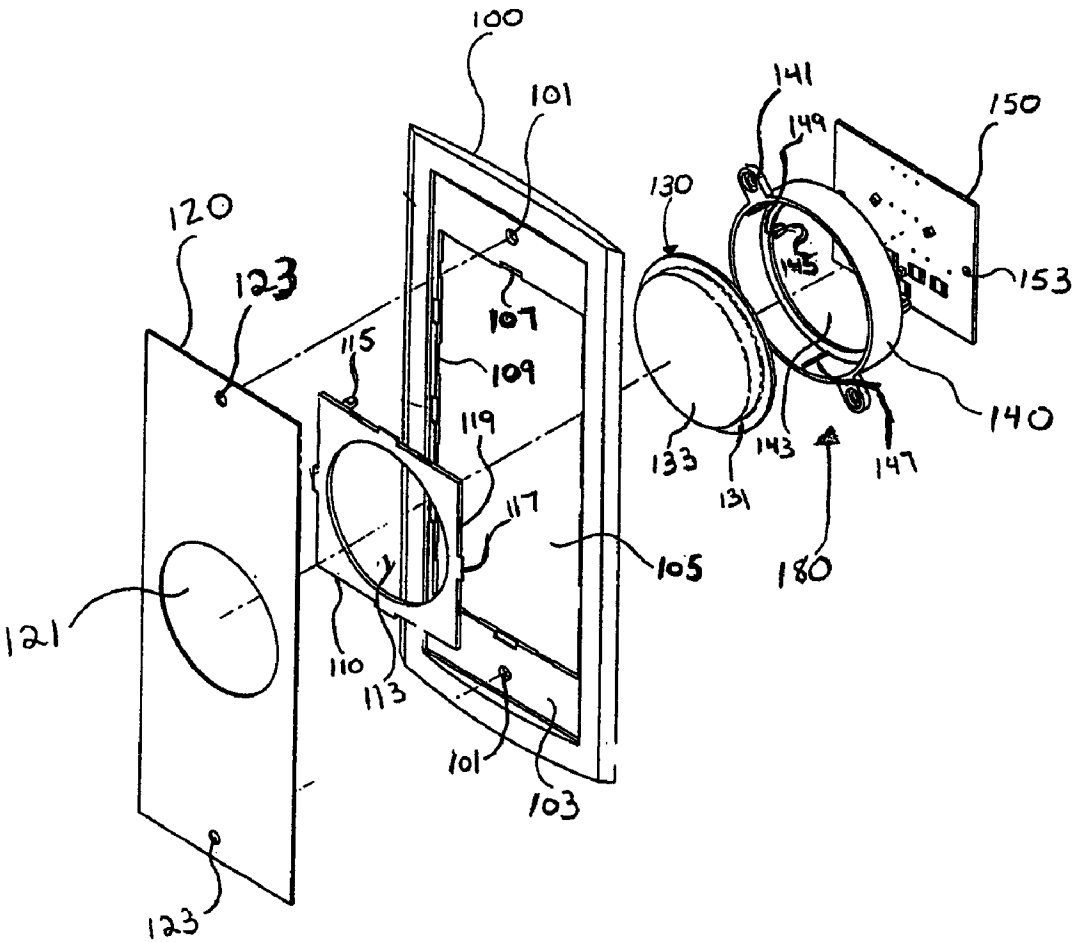
FIG. 1 is a diagram showing an embodiment of a directional lantern indicator fixture assembly according to the present invention for a terminal floor in an elevator system.
Figure 1A:
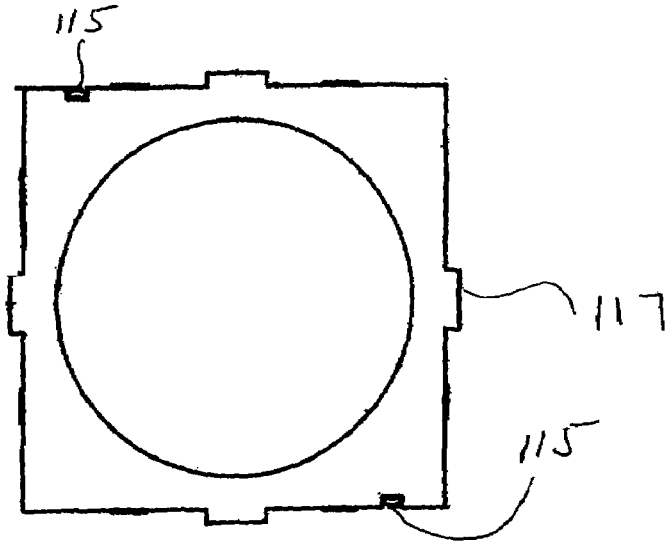
FIG. 1*a* shows a top-down view of a bezel used in an embodiment according to the present invention.
Figure 1B:
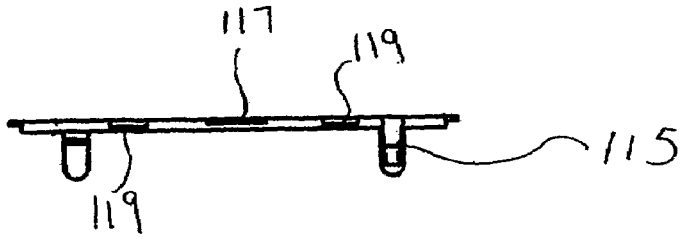
FIG. 1*b* shows a cross sectional view of a bezel used in an embodiment according to the present invention.
Figure 1C:
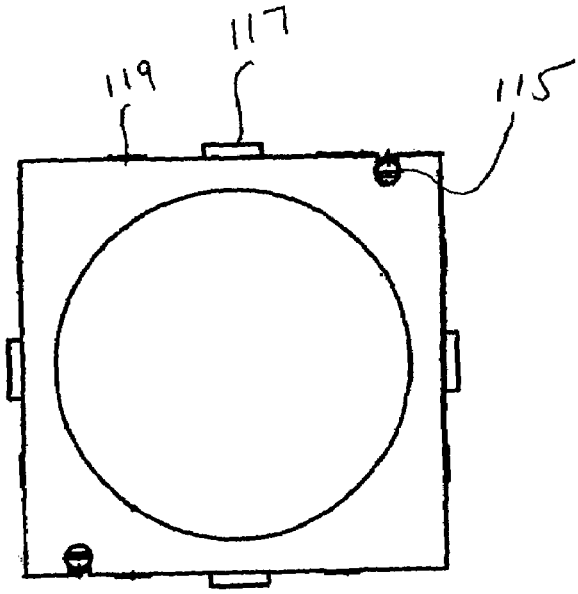
FIG. 1*c* shows a bottom-up view of a bezel used in an embodiment according to the present invention.
Figure 1D:
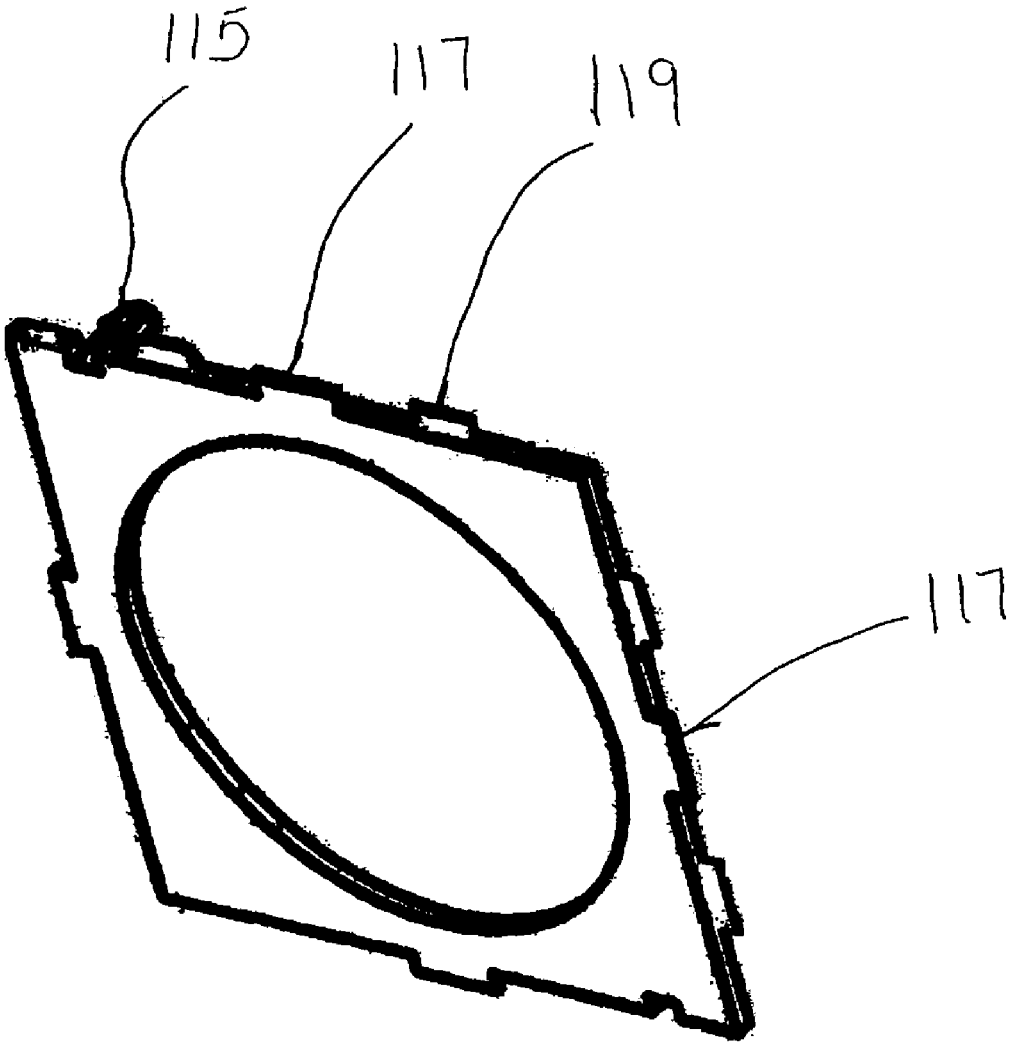
FIG. 1*d* shows an isometric view of a bezel used in an embodiment according to the present invention.

FIG. 1 illustrates an embodiment of a snap fit constructible elevator hall fixture assembly according to the present invention and is described further below. This elevator hall fixture assembly is easily assembled and requires minimal use of screwdrivers and screws because the embodiment uses snap fit pieces. Wall plate 100, which is used for securing the hall fixture assembly to an electrical wall box, has a front surface, a back surface, and holes 101 in its top and bottom edges. Holes 101 are made in wall plate 100 and attached to an electrical wall box by methods known in the art. This embodiment uses, but is not limited to, two holes 101 in the wall plate. A different number of holes 101 may be used as required by specific applications. The front surface of wall plate 100 has a recessed portion 103. An opening 105 is made in the recessed portion 103 of the wall plate 100 by methods known in the art. Grooves 107 are dispersed around the perimeter of the front surface abutting opening 105. The back surface of wall plate 100 has grooves 109 dispersed around its perimeter abutting opening 105. The number of grooves 107 and grooves 109 required depends on a specific application's requirements. Grooves 107 and grooves 109 on wall plate 100 are used to secure bezel pieces, such as bezel 110, to the wall plate 100.

Bezel 110 has an opening 113, a front surface, a back surface, and struts 115 protruding from the back surface. A first snap-fit coupling connects bezel 110 to wall plate 100. This first snap-fit coupling can be comprised of any materials that will snap-fit the wall plate 100 to the bezel 110. In this embodiment, the first snap-fit coupling occurs in the following manner. The front surface of bezel 110 has protrusions 117 dispersed on its perimeter. Protrusions 117 are snap-fitted to the grooves 107 located on the front surface of the wall plate 100. The back surface of bezel 110 has protrusions 119 dispersed on its perimeter. These protrusions 119 are snap-fitted to the grooves 109 located on the back surface of the wall plate 100. FIGS. 1*a*–1*d* show different views of bezel 110 to more definitively show the location of the pieces on bezel 110.

For aesthetic purposes, a decorative faceplate 120 is placed on top of the wall plate 100 to hide wiring and components. Decorative faceplate 120 has an opening 121 that has similar dimensions to bezel opening 113, a hole 123 in the top edge of faceplate 120, and a hole 123 in the bottom edge of faceplate 120. The hole 123 in the top edge of the faceplate 120 is aligned with the hole 101 in the top edge of the wall plate 100 and is attached according to methods known in the art. For example, a screw could be placed through both top edge hole 123 and top edge hole 101 and then screwed into an electrical wall box. The hole 123 in the bottom edge of the faceplate 120 is aligned with the hole 101 in the bottom edge of the wall plate 100 and is attached according to methods known in the art. Again, a screw could be placed through both bottom edge hole 123 and bottom edge hole 101 and then screwed into an electrical wall box. The faceplate 120 is mounted into the recessed 103 portion of wall plate 100.

A hall fixture can tell a passenger the directional movement (up or down) of the elevator (this is known as a directional lantern indicator), or the hall fixture can be used to call an elevator and instruct the elevator in which direction to move (this is known as a hall-call push button). In this embodiment according to the present invention, hall fixture 180 is a directional lantern indicator which is used to tell a passenger the directional movement of the elevator and comprises a reflector 140, a lens 130, and a printed circuit board 150. Hall fixture 180 is disposed in opening 113 of bezel 110. A second snap-fit coupling connects hall fixture 180 to bezel 110. This second snap-fit coupling can be comprised of any materials that will snap-fit hall fixture 180 to bezel 110.

In this embodiment, the second snap-fit coupling occurs in the following manner. Reflector 140, which is a part of hall fixture 180, has sockets 141 located on its outer periphery. Sockets 141 are snap-fitted to bezel struts 115 for a secure attachment. The embodiment illustrated in FIG. 1 shows, but is not limited to, two sockets 141 and two bezel struts 115. Any number of sockets 141 or bezel struts 115 can be used, depending on a specific application's requirements.

Reflector 140 also has an opening 143, vertically protruding legs 145, vertically extending rib protrusions 147 on the inner wall of reflector 140, and a rim 149.

Lens 130 has a base 131 and a body 133 attached to base 131. The lens 130 is slid into reflector opening 143. Rib protrusions 147 located on the inner wall of reflector 140 press against lens body 133, creating friction between rib protrusions 147 and lens body 133 and securing the lens body 133 to reflector 140 with the friction. Lens body 133 is extended through bezel opening 113 and faceplate opening 121, and lens base 131 is secured to the rim 149 of reflector 140.

A printed circuit board 150 illuminates lens 130 when activated because the circuit board 150 has superluminescent diodes. The illuminated lens shows in which direction the elevator will move next. This embodiment uses, but is not limited to, superluminescent diodes. Other illuminating materials can be used according to the requirements of a specific application.

A third snap-fit coupling attaches circuit board 150 to reflector 140. This third snap-fit coupling can be comprised of any materials that snap-fit circuit board 150 to reflector 140. In this embodiment, the third snap-fit coupling occurs in the following manner. The circuit board 150 has openings 153 that snap-fit to reflector legs, 145 thereby securing circuit board 150 to reflector 140. In this embodiment, there are two circuit board openings 153 and two reflector legs 145. However, the embodiment is not limited to this number of legs 145 or openings 153, any number can be used according to the requirements of a specific application.

In FIG. 1, the elevator hall fixture assembly is mounted vertically onto a wall. But, as shown in FIG. 3*b*, this hall fixture assembly can also be mounted horizontally onto a wall. It depends on the requirements of a specific application.

Figure 2:
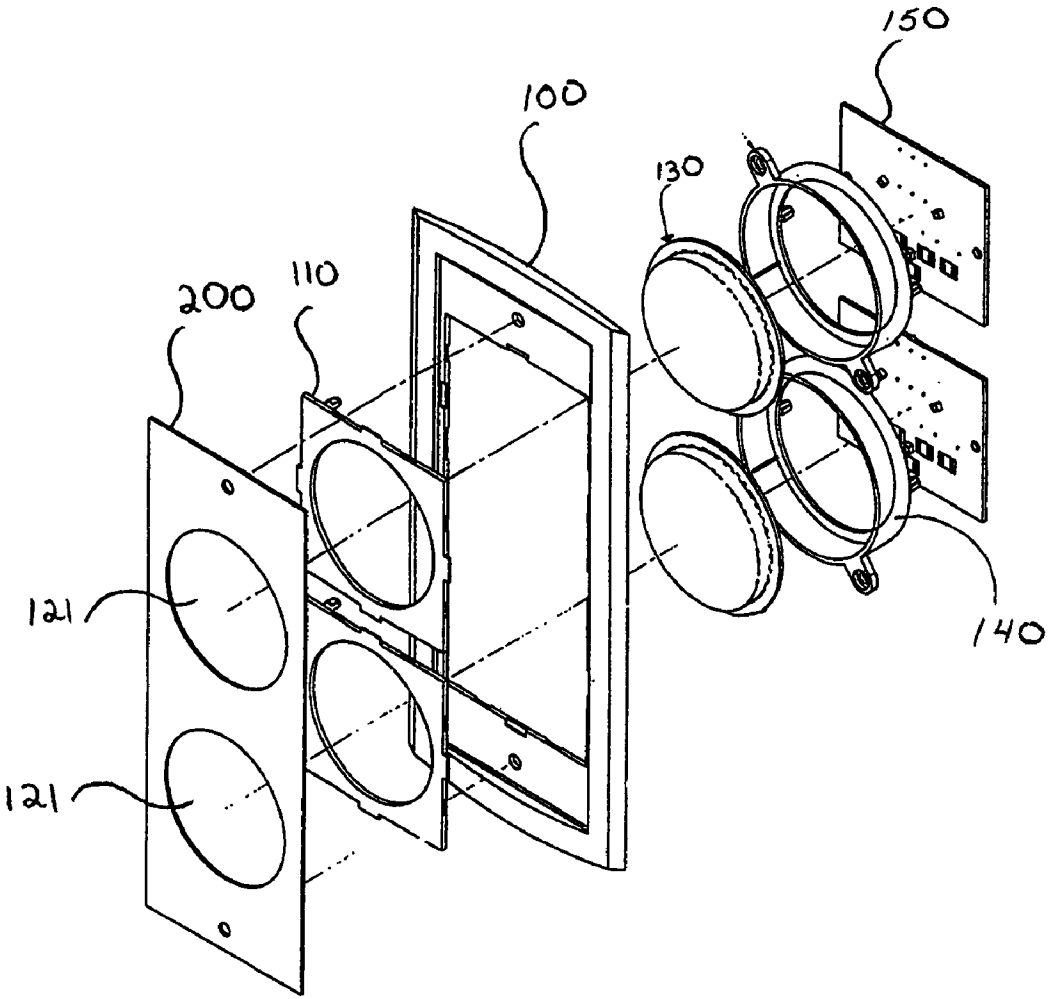
FIG. 2 is a diagram showing an embodiment of a directional lantern indicator fixture assembly according to the present invention for an intermediate floor in an elevator system.

FIG. 2 is another embodiment of the present invention and is assembled according to the description in FIG. 1. However, FIG. 2 includes an additional bezel 110, lens 130, reflector 140, and circuit board 150. Each of these parts is assembled according to the description in FIG. 1. Faceplate 200 has an additional opening 121 to receive the additional bezel 110, lens 130, reflector 140, and circuit board 150 installed in wall plate 100.

Figure 3A:
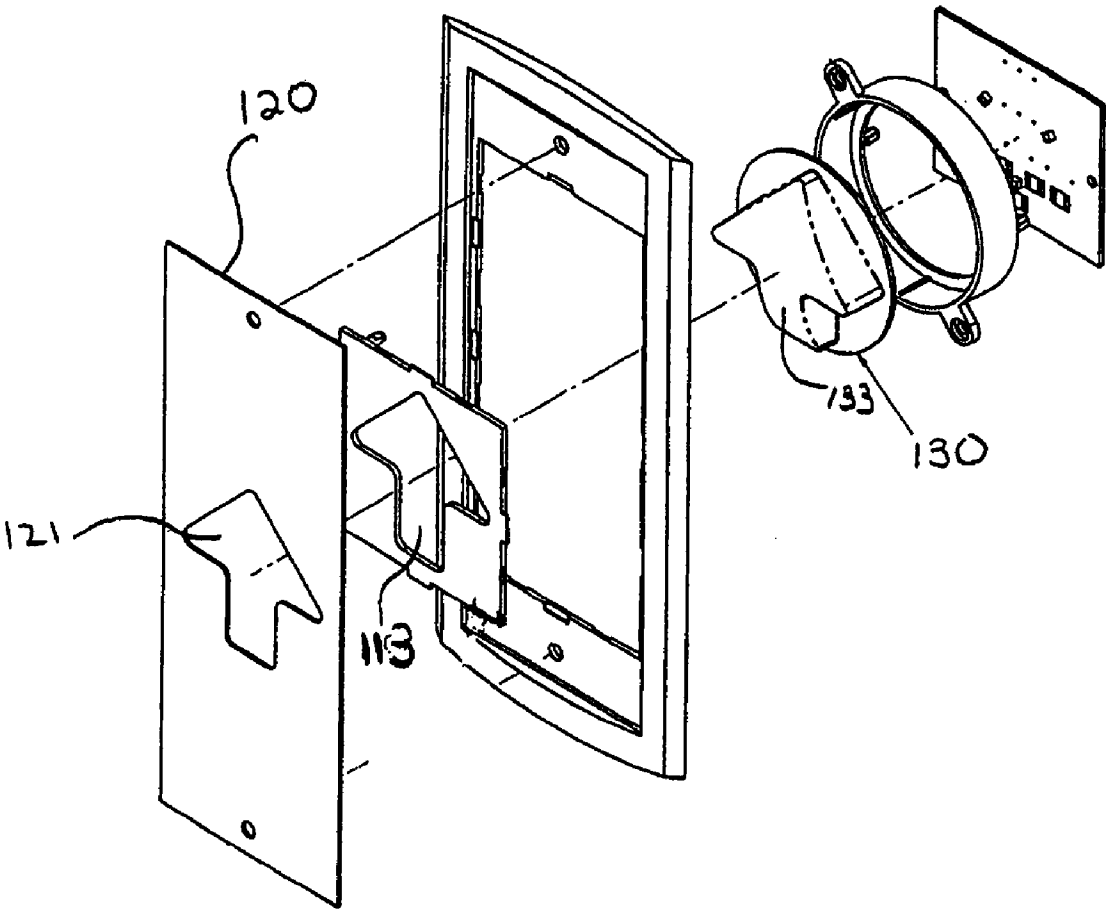
FIG. 3*a* shows how the embodiment of FIG. 1 can be adapted to have lenses of different shapes.
Figure 3B:
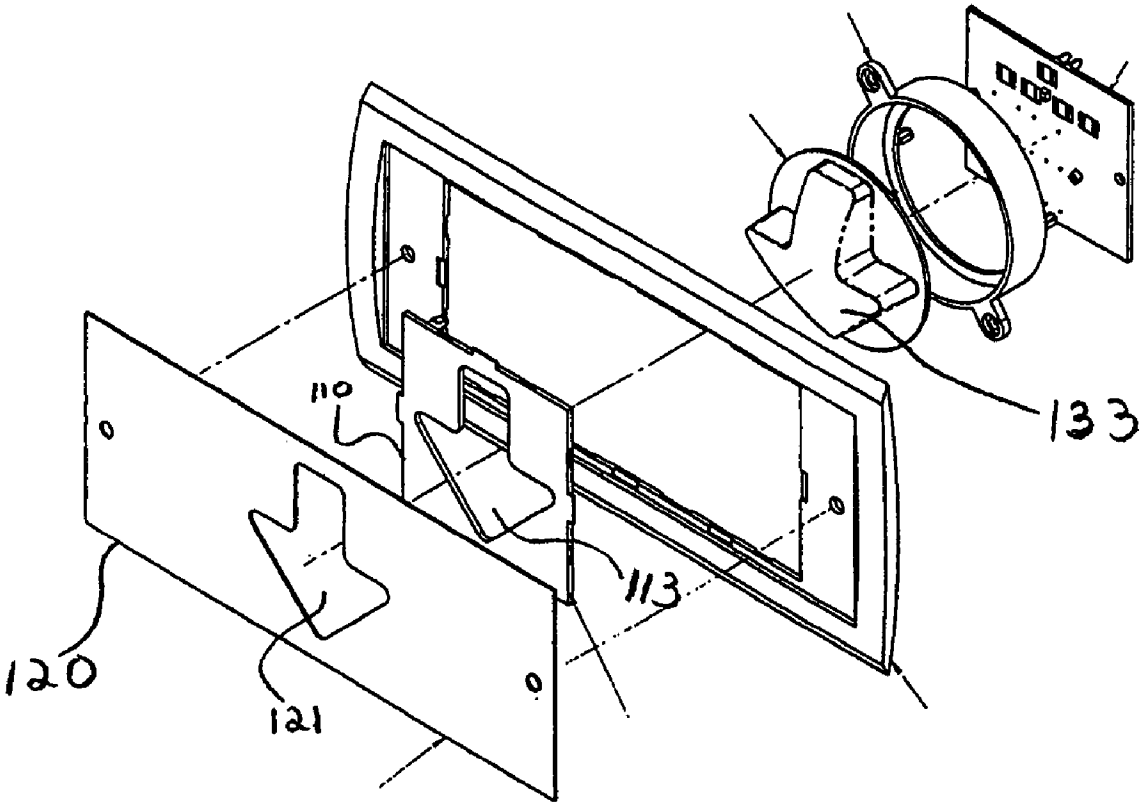
FIG. 3*b* shows how the embodiment of FIG. 1 can be adapted to have lenses of different shapes.

FIGS. 3*a* and 3*b* are also assembled according to the description in FIG. 1. The only difference between FIG. 1 and FIGS. 3*a* and 3*b* is the shape of the faceplate opening 121, bezel opening 113, and lens body 133. For aesthetic purposes, the shape of these items are formed in the shape of an up arrow (for FIG. 3*a*) or a down arrow (for FIG. 3*b*) to show the elevator's movement. The hall fixture assemblies illustrated in FIGS. 3*a* and 3*b* are known as terminal hall fixture assemblies because they are located on the last, "terminal", floor that an elevator reaches. FIG. 3*a* is a terminal hall fixture assembly with an up arrow, this is used on the bottom floor of a building where the elevator could only move upwards. FIG. 3*b* is a terminal hall fixture assembly with a down arrow, this is used on the top floor of a building where the elevator could only move downwards.

Figure 4A:
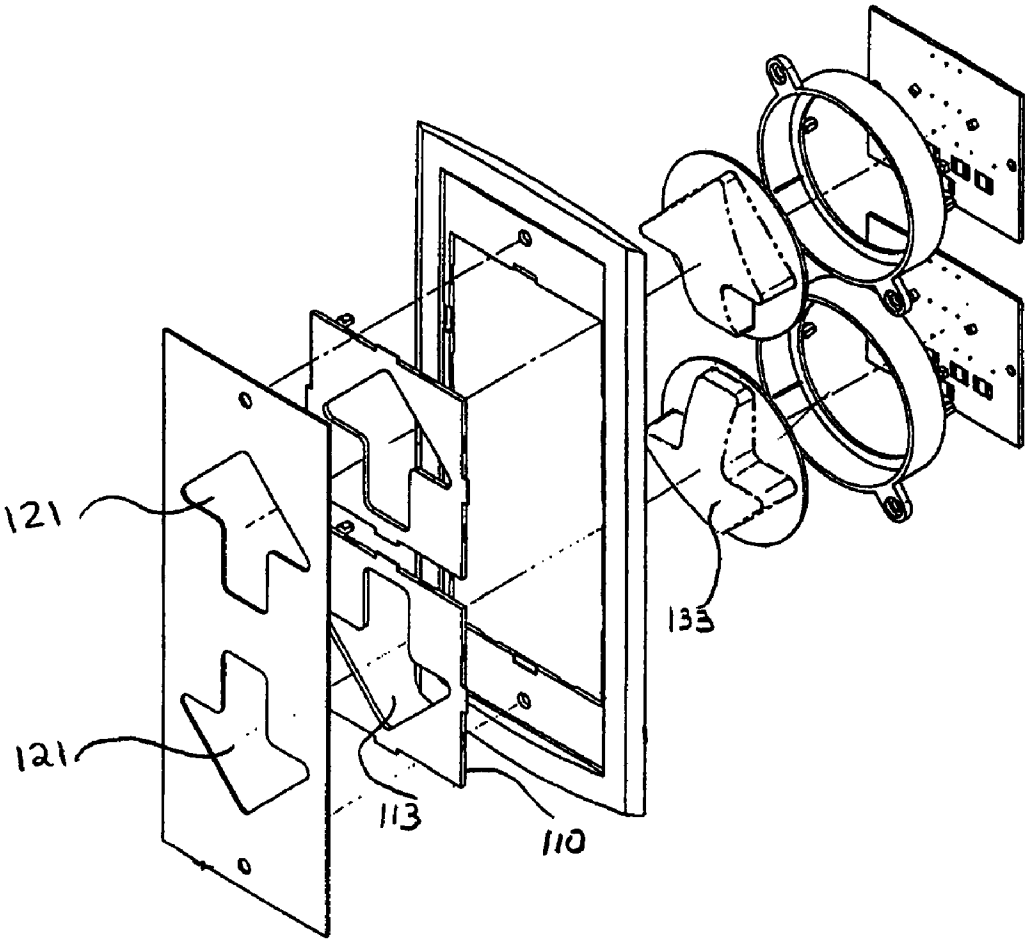
FIG. 4*a* is a diagram showing an embodiment of a directional lantern indicator fixture assembly according to the present invention in a vertical position for an intermediate floor in an elevator system.
Figure 4B:
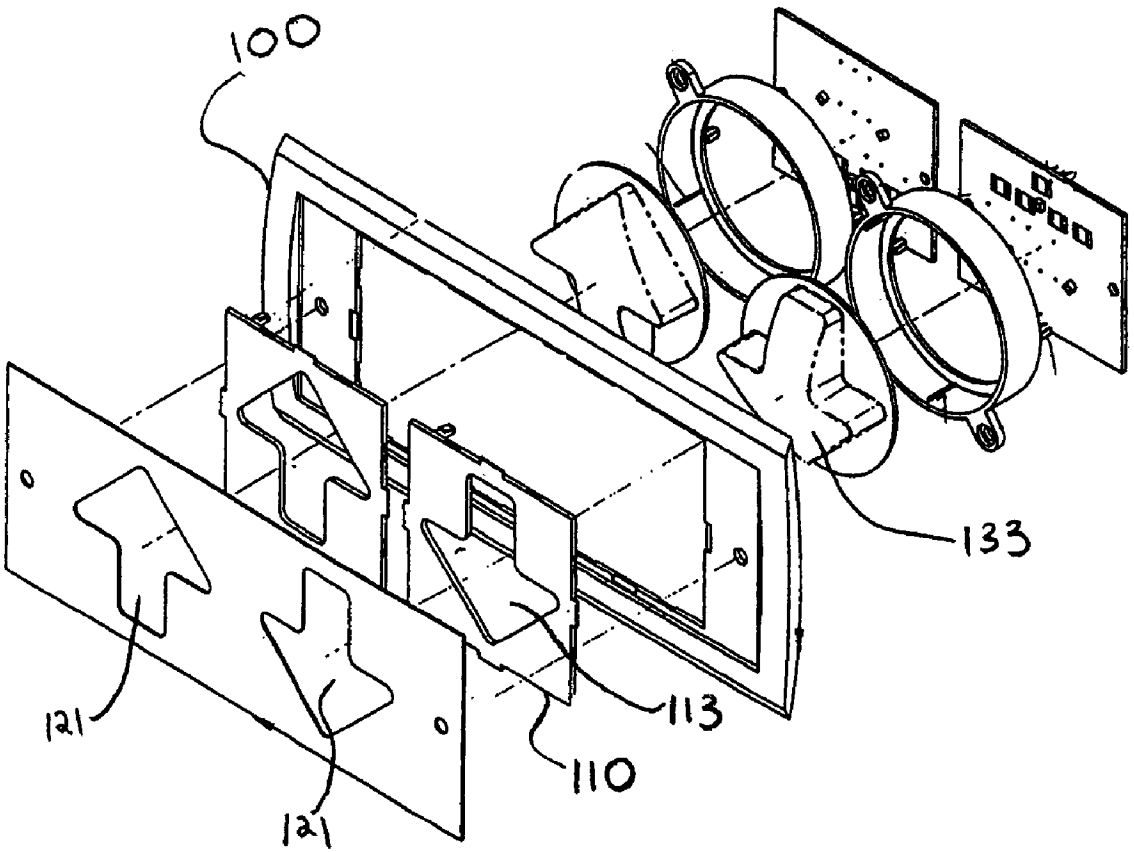
FIG. 4*b* is a diagram showing an embodiment of a directional lantern indicator fixture assembly according to the present invention in a horizontal position for an intermediate floor in an elevator system.
Figure 4C:
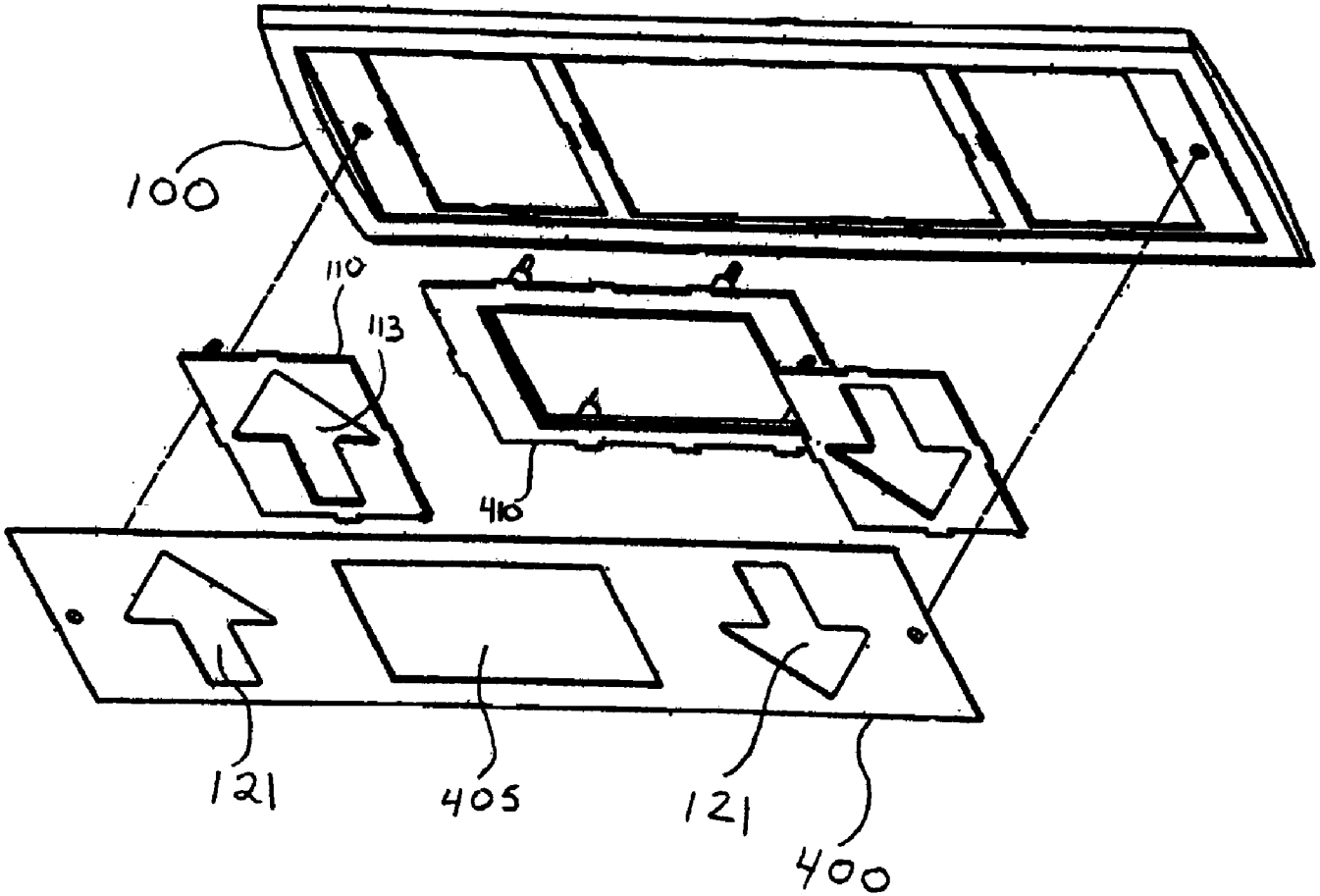
FIG. 4*c* is a diagram showing an embodiment of a directional lantern indicator fixture assembly according to the present invention in a horizontal position for an intermediate floor in an elevator system.

FIGS. 4*a* and 4*b* are assembled according to the description in FIG. 2. However, the shape of the faceplate opening 121, bezel opening 113, and lens body 133 differ from FIG. 2 to FIGS. 4*a* and 4*b*. For aesthetic purposes, in FIGS. 4*a* and 4*b* the shape of these items are formed in the shape of an up arrow or a down arrow to show the elevator's movement. The hall fixture assemblies illustrated in FIGS. 4*a* and 4*b* are called "intermediate" assemblies, meaning they can be installed on any floor because both an up and down arrow are represented. FIG. 4*c*, which is also an intermediate assembly, represents another embodiment according to the present invention. FIG. 4*c* is assembled according to FIG. 4*b*, however, faceplate 400 used in FIG. 4*c* has an extra faceplate opening 405 and an extra bezel 410. Bezel 410 is snap-fit to wall plate 100 as described in FIG. 1. A printed circuit board with a dot matrix readout (not shown) is shown through bezel 410 and faceplate opening 405. This readout shows on which floor the elevator is located.

Figure 5:
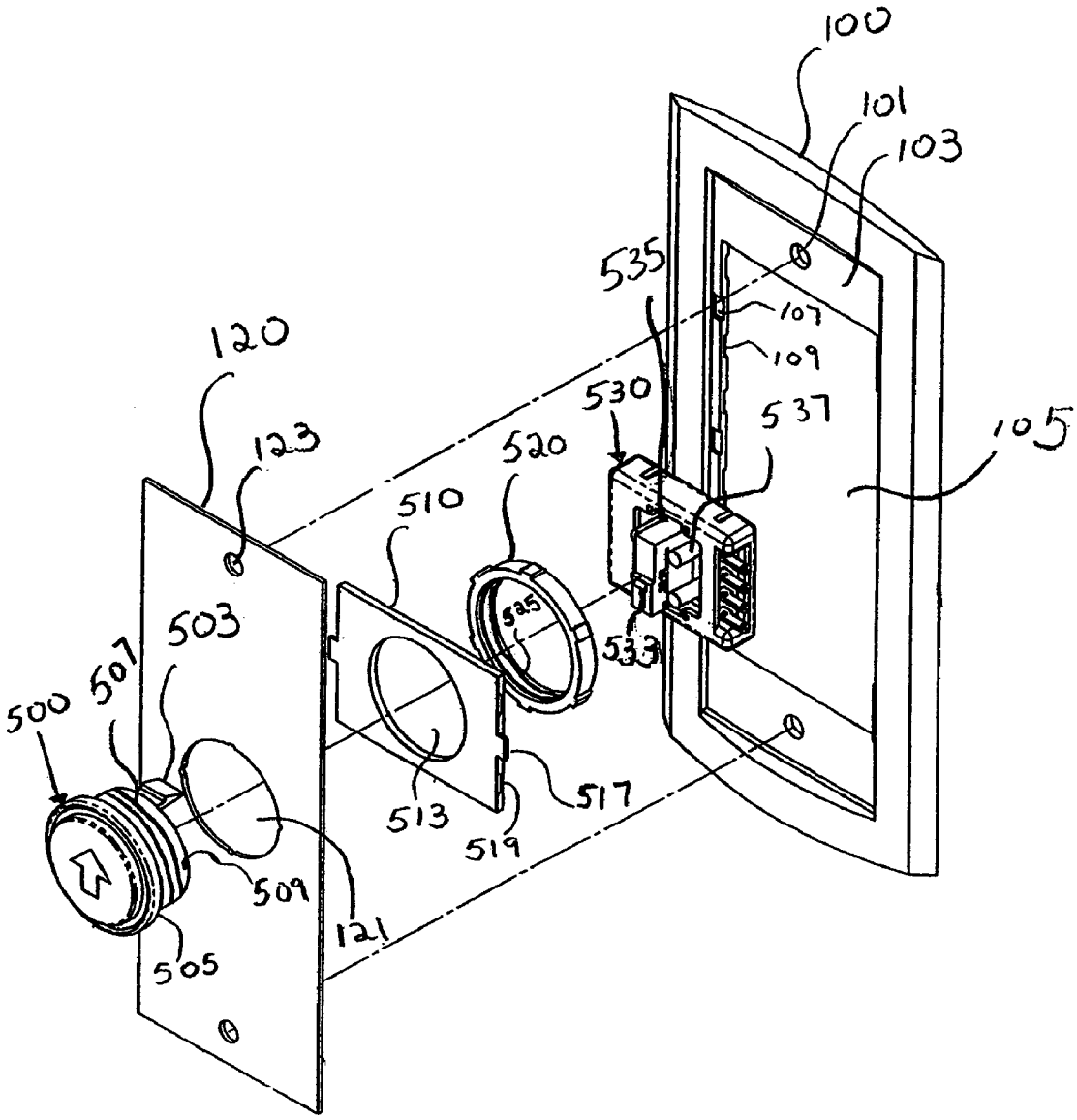
FIG. 5 is a diagram showing an embodiment of a hall call push-button fixture assembly according to the present invention for a terminal floor in an elevator system.

FIG. 5 illustrates an embodiment of a snap fit constructible elevator hall fixture assembly according to the present invention. This embodiment is assembled similar to the description in FIG. 1 and, because the embodiment uses snap-fit pieces, requires minimal use of the wrist. FIG. 5 is a terminal hall fixture assembly for the bottom floor because it has a directional up-arrow. Wall plate 100, which is used for securing the hall fixture assembly to an electrical wall box, has a front surface, a back surface, a hole 101 in its top edge, and a hole 101 in its bottom edge. Holes 101 are made in wall plate 100 and attached to an electrical wall box by methods known in the art. This embodiment uses, but is not limited to, two holes 101 in the wall plate. A different number of holes 101 may be used as required by specific applications. The front surface of wall plate 100 has a recessed portion 103. An opening 105 is made in the recessed portion 103 of the wall plate 100 by methods known in the art. Grooves 107 are dispersed around the perimeter of the front surface abutting opening 105. The back surface of wall plate 100 has grooves 109 dispersed around its perimeter abutting opening 105. The number of grooves 107 and grooves 109 required depends on a specific application's requirements. Grooves 107 and grooves 109 on wall plate 100 are used to secure bezel pieces, such as bezel 510, to the wall plate 100.

Bezel 510 has an opening 513, a front surface, and a back surface. One advantage to the present invention concerns the interchangeability of its bezel pieces. Every bezel in this invention is interchangeable and can be used in any wall plate. For example, bezel 110 which is used in FIG. 1 is interchangeable with, and could be used instead of, bezel 510 in FIG. 5. Also, as an example, Bezel 110 could also be used as the bezel in FIG. 6 or bezel 510 could be used in FIG. 4.

A first snap-fit coupling connects bezel 510 to wall plate 100. This first snap-fit coupling can be comprised of any materials that will snap-fit the wall plate 100 to the bezel 510. In this embodiment, the first snap-fit coupling occurs in the following manner. The front surface of bezel 510 has protrusions 517 dispersed on its perimeter. Protrusions 517 are snap-fitted to the grooves 107 located on the front surface of the wall plate 100. The back surface of bezel 510 has protrusions 519 dispersed on its perimeter. These protrusions 519 are snap-fitted to the grooves 109 located on the back surface of the wall plate 100.

As with FIG. 1, FIG. 5 has a decorative faceplate 120 placed on top of the wall plate 100 to hide any unsightly wiring or components. Decorative faceplate 120 has an opening 121 that has similar dimensions to bezel opening 513, a hole 123 in the top edge of faceplate 120, and a hole 123 in the bottom edge of faceplate 120. The hole 123 in the top edge of the faceplate 120 is aligned with the hole 101 in the top edge of the wall plate 100 and is attached according to methods known in the art. For example, a screw could be placed through both top edge hole 123 and top edge hole 101 and then screwed into an electrical wall box. The hole 123 in the bottom edge of the faceplate 120 is aligned with the hole 101 in the bottom edge of the wall plate 100 and attached according to methods known in the art. Again, a screw could be placed through both bottom edge hole 123 and bottom edge hole 101 and then screwed into an electrical wall box. The faceplate 120 is mounted into the recessed 103 portion of wall plate 100.

In this embodiment according to the present invention, the hall fixture is a hall-call push button which calls an elevator and instructs the elevator in which direction to move. To call an elevator, passengers use the hall fixture. The hall fixture in this embodiment is disposed in bezel opening 513 and comprises a push button 500 and an electrical switch device 530.

Push button 500 has a body 509, struts 503 extending from the body 509, a shoulder 505, and threads 507 that are located on the outer periphery of the body 509. Threads 507 extend around the circumference of body 509. This embodiment contains, but is not limited to, multiple struts 503 and threads 507. One or more struts 503 and threads 507 can be used according a specific application's requirements. The push button 500 is placed through bezel opening 513 and faceplate opening 121. Shoulder 505, which has a larger circumference than the circumference of opening 121 on faceplate 120, abuts a portion of faceplate 120 that surrounds faceplate opening 121. This abutment ensures that push button 500 is secured to the hall fixture assembly and does not fall through faceplate opening 121 or bezel opening 513.

A locking nut 520 secures push button 500 to faceplate 120 and bezel 510. Locking nut 520 has threads 525 located on its inner periphery that twist onto threads 507 located on push button 500. The locking nut 520 abuts a portion of the back surface of bezel 510, which tightens push button 500 against faceplate 120 and bezel 510.

A second snap-fit coupling connects the hall fixture of this embodiment to bezel 510. Any materials that will snap-fit the hall fixture of this embodiment to bezel 510 can be used. In this embodiment, the second snap-fit coupling occurs in the following manner. Electrical switch device 530 has slots 535 shaped to accept push button struts 503. Push button 500 is extended through bezel opening 513 and push button struts 503 are snap-fit to slots 535. Therefore bezel 510 is located between push button 500 and electrical switch device 530 (the pieces that comprise the hall fixture) and therefore is attached to the hall fixture.

Electrical switch device 530 has an activation switch 533 and light emitting diodes ("LED") 537. When push button 500 presses against activation switch 533, the activation switch 533 illuminates LEDs 537, which in turn illuminate push button 500. A lit push button indicates that someone has called an elevator. Depending on the requirements of a specific application, any light emitting device that becomes lit when activated can be used.

Figure 6:
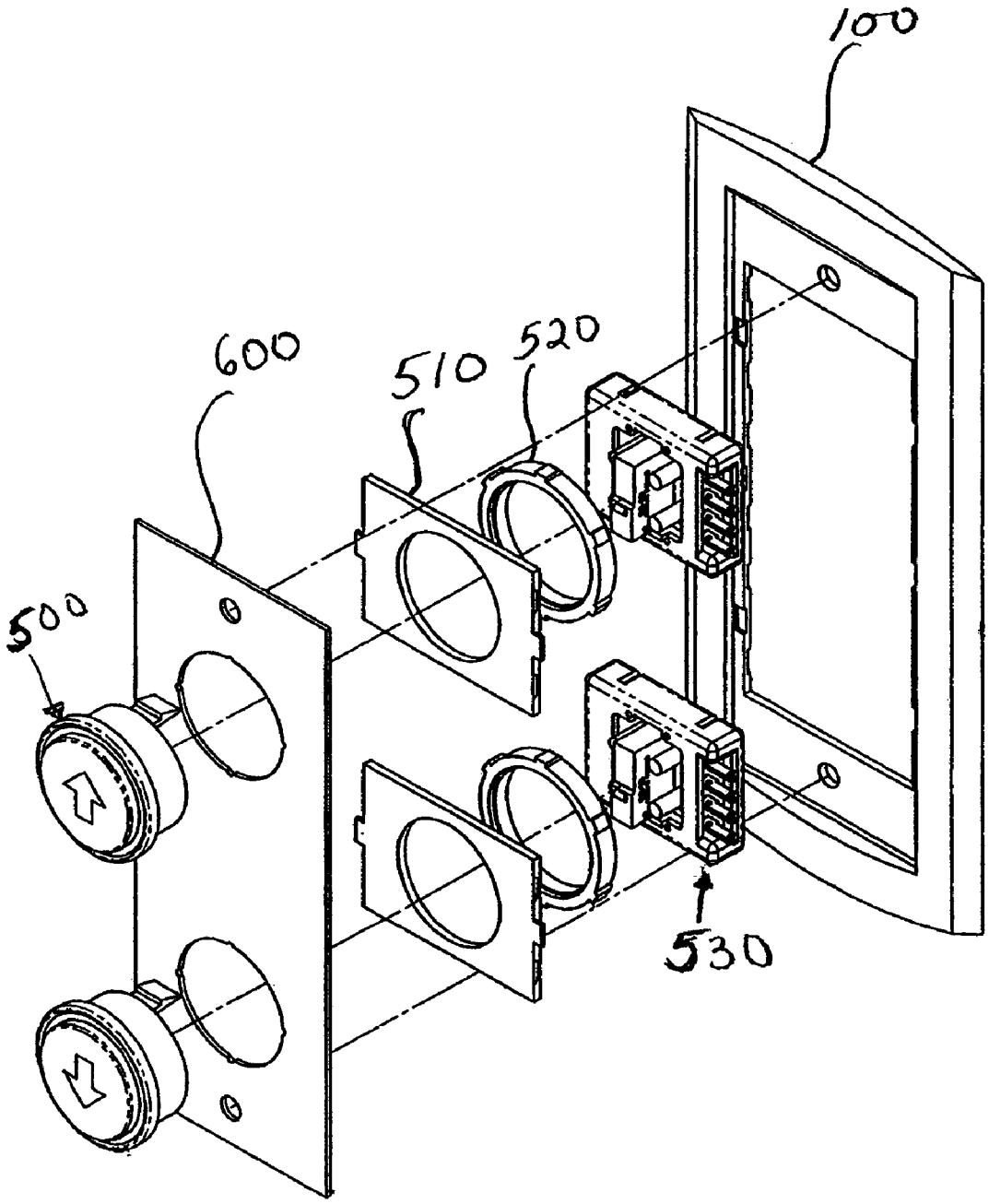
FIG. 6 is a diagram showing an embodiment of a hall call push-button fixture assembly according to the present invention for an intermediate floor in an elevator system.

FIG. 6 includes an additional push button 500, bezel 510, locking nut 520, and electrical switch device 530 that are not included in FIG. 5. However, because all the components are snap fit, these additional components are assembled as described in FIG. 5. To accept these additional pieces being installed in wall plate 100, faceplate 600 has two faceplate openings. FIG. 6 is an intermediate hall fixture assembly, which can be used on any floor of a building, because it has push buttons in the shape of both an up arrow and a down arrow. Pressing a directional arrow calls the elevator and indicates in which direction the passenger wants to move.

Figure 7:
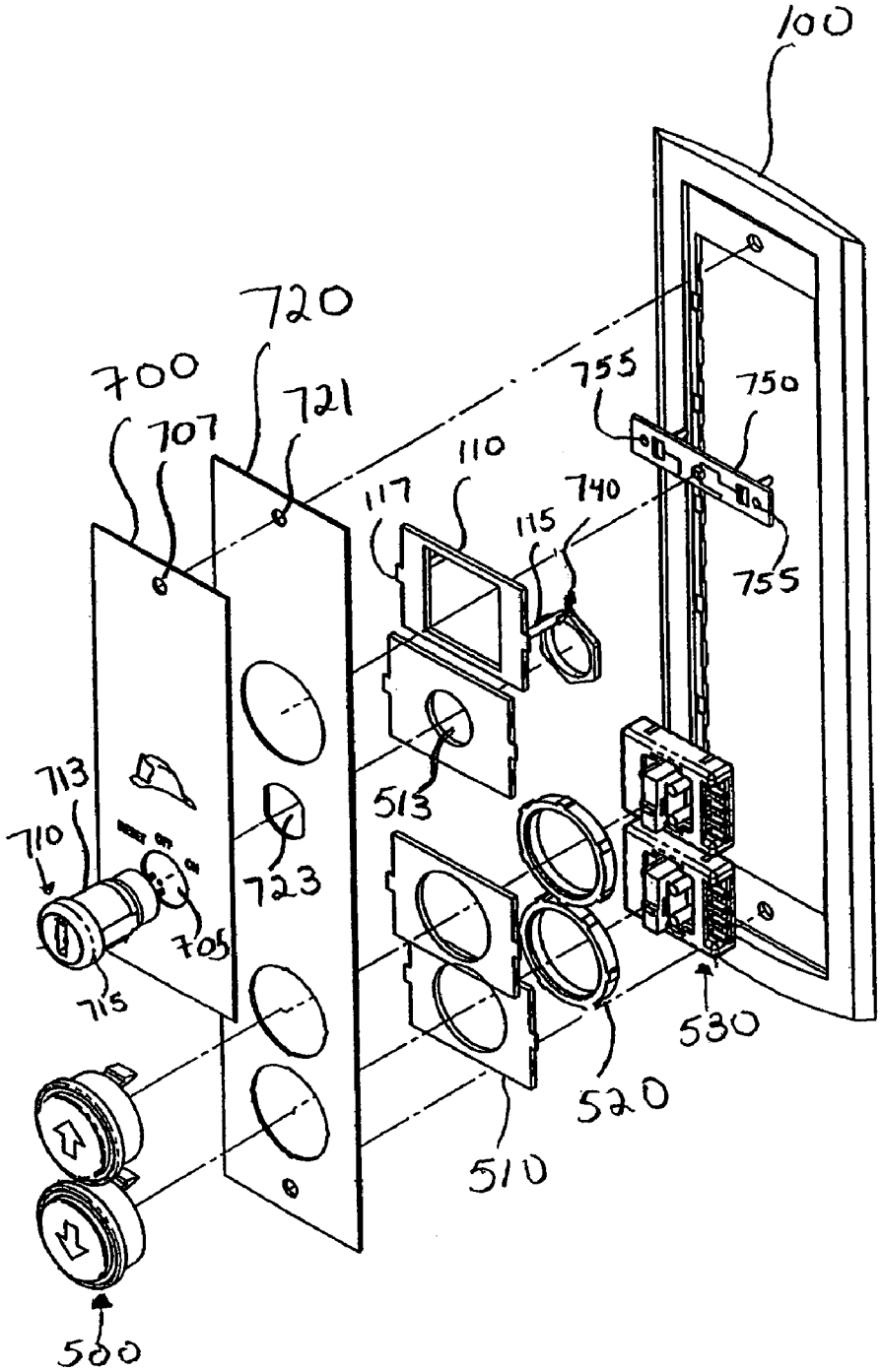
FIG. 7 is a diagram showing an embodiment of a hall call push-button fixture assembly according to the present invention for an intermediate floor in an elevator system, with an emergency-service key-switch.

FIG. 7 adds an emergency-service feature to the elevator hall fixture assembly. Like FIG. 6, FIG. 7 also includes an additional push button 500, bezel 510, locking nut 520, and electrical switch device 530 not included in FIG. 5. However, these components are identical to the components assembled in FIG. 5, and therefore are assembled according to the description in FIG. 5.

In FIG. 7, an emergency-service faceplate 700 has an opening 705 and a hole 707 on its top edge. Hole 707 is aligned with a top edge hole 721 on decorative faceplate 720 and attached to faceplate 720 and wall plate 100 as known in the art. A key-switch 710 having a body 713 and a shoulder 715 is extended through bezel opening 513, faceplate opening 723, and emergency faceplate opening 705. Shoulder 715, which has a larger circumference than the circumference of opening 705 on emergency faceplate 700, abuts a portion of faceplate 700 that surrounds emergency faceplate opening 705. This abutment ensures that key-switch 710 is secured to the hall fixture assembly and does not fall through faceplate opening 705. A switch nut 740 is secured to key-switch 710 and secures key-switch 710 to bezel 510, faceplate 720, and emergency faceplate 700.

Printed circuit board 750 has two openings 755 for attaching to bezel 110 and a superluminescent diode for illuminating emergency faceplate 700. This embodiment uses, but is not limited to, superluminescent diodes. Other illuminating materials can be used according to the requirements of a specific application. In this diagram, bezel 110 is also called a printed circuit board bezel because bezel 110 is used in conjunction with circuit board 750. Bezel struts 115 snap-fit into openings 755, securing circuit board 750 to bezel 110. Bezel 110 is snap-fitted to wall plate 100 as described in FIG. 1. When the key-switch 710 is turned to the "on" position, the superluminescent diode on circuit board 750 illuminates letting passengers know that the emergency-service option is engaged.

Faceplate 720 has four openings 723, extending out of two of the openings are up and down push buttons. As described above, key-switch 710 uses an opening 723, and one opening 723 is extra. Faceplate 700 and 720 are both secured to wall plate 100 by screwing faceplates 700 and 720 to wall plate 100.

Just like in FIG. 6, the push buttons in FIG. 7 are in the shape of an up arrow and a down arrow to show in which direction the passenger wants to be transported. Pressing a directional arrow calls the elevator and indicates in which direction the passenger wants to move. The embodiment illustrated FIG. 7 is an intermediate fixture assembly because both up and down arrows are represented.

Figure 8:
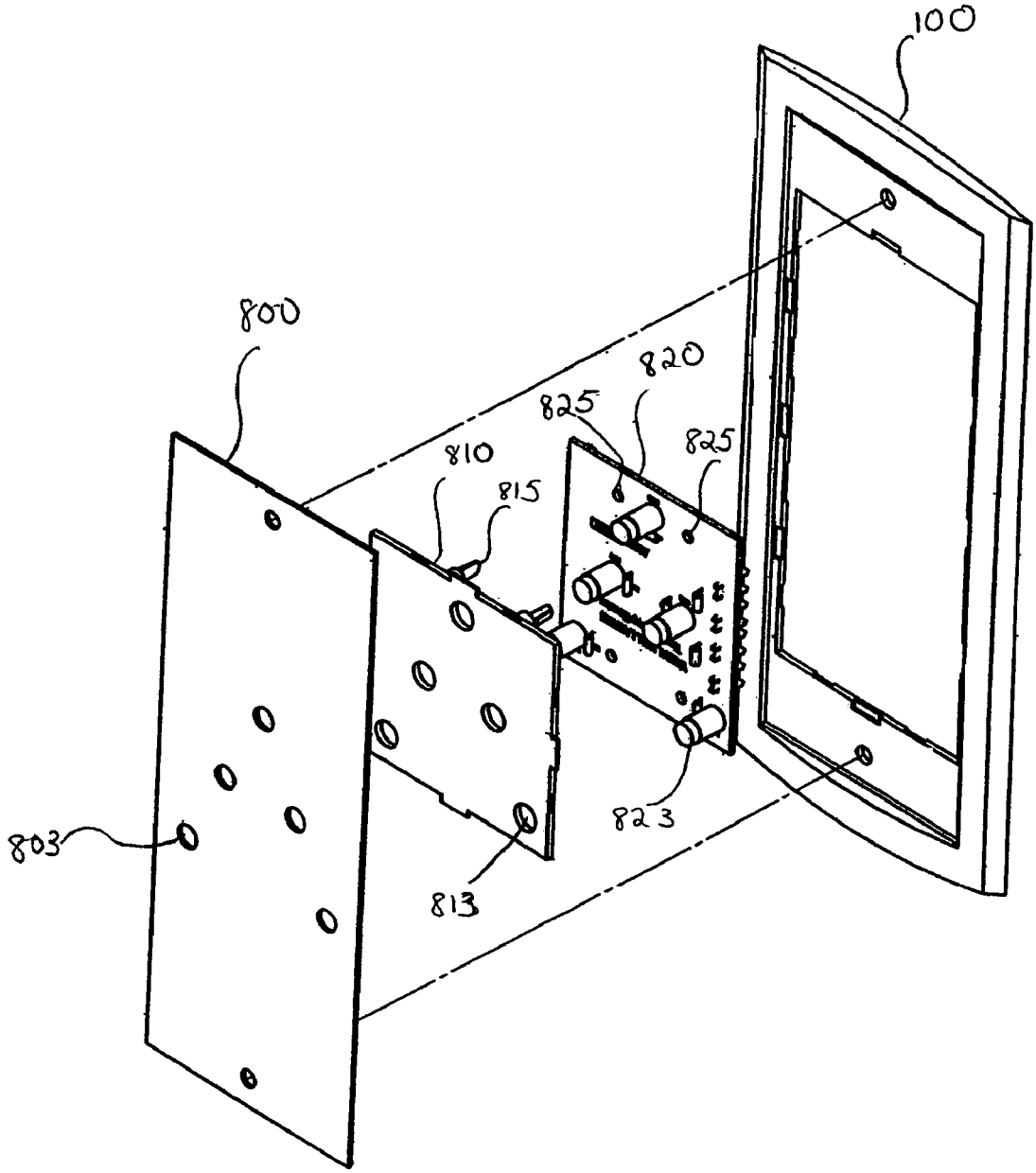
FIG. 8 is a diagram showing an embodiment of a directional lantern indicator fixture assembly according to the present invention for a terminal floor in an elevator system.

FIG. 8 illustrates another embodiment according to the present invention. Bezel 810 is snap-fit to wall plate 100 with a first snap-fit coupling as described in FIG. 1. Bezel 810 has struts 815 along with openings 813, however, one or more openings 813 and struts 815 may be used as required by a specific application. Bezel 810 is attached to printed circuit board 820 by a second snap-fit coupling, which in this embodiment occurs in the following manner. Struts 815 are snap-fit to openings 825 on printed circuit board 820. Faceplate 800 has openings 803 formed to the same pattern as openings 813 on bezel 810. LEDs 823 are located on printed circuit board 820, and are disposed through bezel opening 813 and faceplate opening 803 but do not extend through faceplate openings 803. This type of assembly is known in the art as a vandal lantern because, unlike in FIG. 1, where lens 130 protrudes through bezel opening 113 and is exposed to vandals, here the entire assembly in FIG. 8 is inside the faceplate and not exposed to vandals. FIG. 8 is a terminal fixture assembly.

Figure 9:
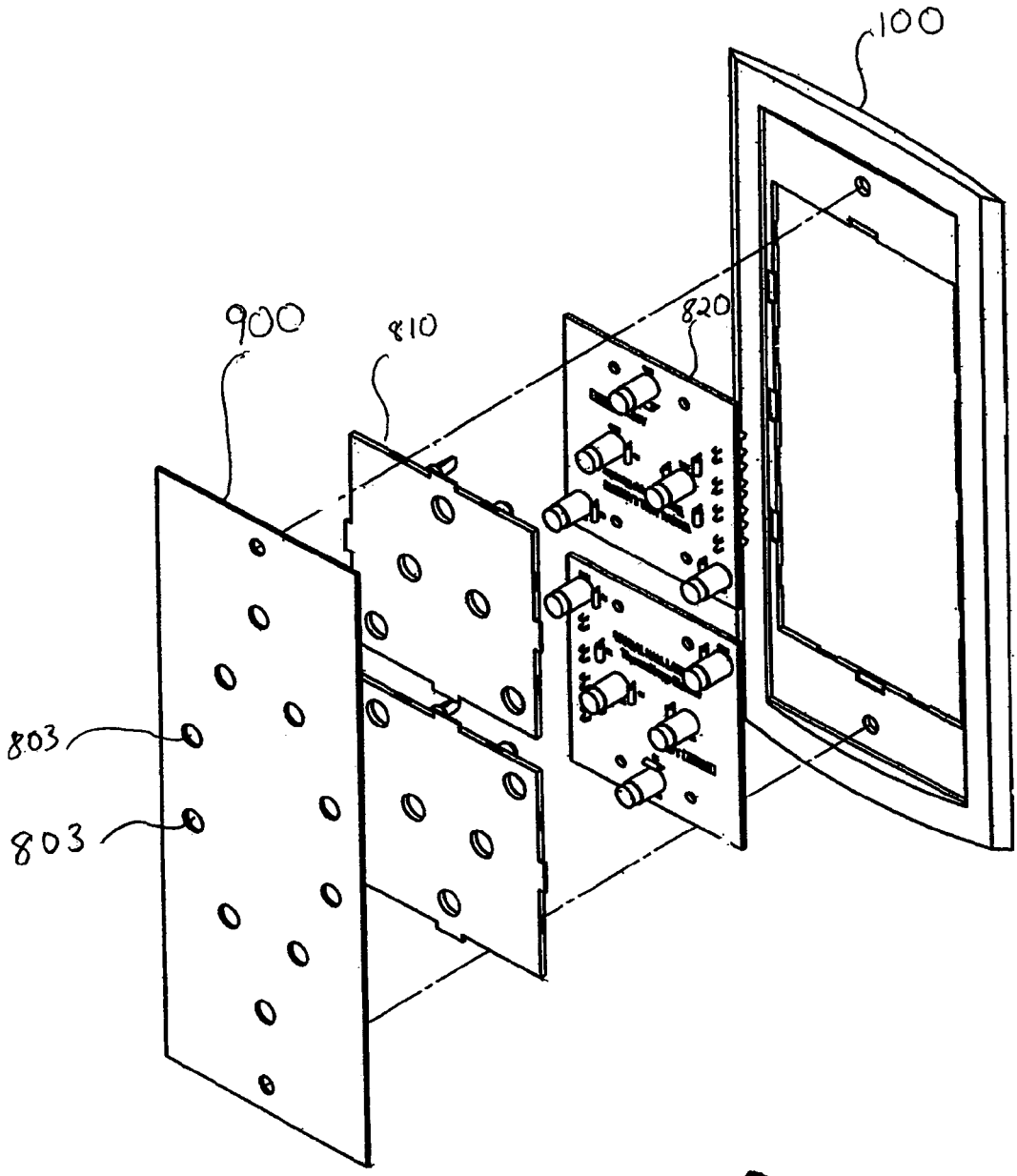
FIG. 9 is a diagram showing an embodiment of a directional lantern indicator fixture assembly according to the present invention for an intermediate floor in an elevator system.

FIG. 9 is assembled according to the description of FIG. 8, except there is an additional bezel 810 and printed circuit board 820. Faceplate 900 has additional openings 803 to receive the additional bezel 810 and printed circuit board 820. FIG. 9 is an intermediate fixture assembly.

One advantage to the present invention is the flexibility in the designs of the hall fixture assemblies. For example, if the elevator in FIG. 7 were to be located at a terminal bottom landing, all that would be required is to make a new faceplate 720 with the correct amount of openings and omit the components associated with the down-arrow pushbutton. Alternatively, because these parts are interchangeable, new types of assemblies can easily be created. For example, if an assembly has a lens 130 with a round base, the assembly could easily be changed to have a lens 130 in the shape of an up arrow. All that would be required is snap-fitting a bezel 110 having a bezel opening 113 in the shape of an up-arrow and using a faceplate 120 that has an opening 121 in the shape of an up-arrow. Instead of installing an entirely new assembly, all that is required is changing three parts, bezel 110, faceplate 120, and lens 130 and a new facade is created.

What is claimed is:

1. A snap-fit constructible elevator hall fixture assembly comprising:

(a) a wall plate;

(b) a bezel;

(c) a first snap fit coupling attaching the wall plate to the bezel;

(d) a hall fixture;

(e) a second snap fit coupling attaching the hall fixture to the bezel, the hall fixture disposed in the opening of the bezel.

2. The assembly of claim 1, further comprising a decorative faceplate having an opening, the faceplate attached to the wall plate and the hall fixture extending through the faceplate opening.

3. The assembly of claim 1, wherein the hall fixture is a directional lantern.

4. The assembly of claim 3, wherein the directional lantern comprises:

(a) a reflector having an opening;

(b) a lens disposed in the reflector opening;

(c) a printed circuit board with light emitting diodes for lighting the lens; and (d) a third snap-fit coupling attaching the printed circuit board to the reflector.

5. The assembly of claim 1, wherein the hall fixture is a hall-call push button.

6. The assembly of claim 5, wherein the hall-call push button comprises:

(a) a push button extending into the bezel; and (b) an electrical switch device, the second snap fit coupling attaching the electrical switch device to the push button.

7. The assembly of claim 1, having a plurality of bezels, the number of bezels corresponding to the number of hall fixtures.

8. A snap-fit constructible elevator hall fixture assembly comprising:

(a) a wall plate having a front surface, a back surface, and an opening, the perimeter of the opening having a plurality of grooves on the front and back surfaces;

(b) a bezel having an opening, a front surface, a back surface, and a plurality of protrusions on the front and back surface for engaging two or more grooves in the wall plate to form snap-fit couple between the bezel and the wall plate;

(c) a hall fixture attached to the bezel and having a portion within the opening of the bezel.

9. A snap-fit constructible elevator hall fixture assembly comprising:

(a) a wall plate having a hole in its top edge and a hole in its bottom edge for attaching the wall plate to an electrical wall box; the wall plate having a front surface, a back surface, and a recessed portion on the front surface, the recessed portion having an opening; the perimeter of the opening on the front surface having a plurality of grooves, and the perimeter of the opening on the back surface having a plurality of grooves;

(b) a decorative faceplate having a faceplate opening, a hole in the top edge of the faceplate, and a hole in the bottom edge of the faceplate; the top edge hole of the faceplate attached to the top edge hole of the wall plate, and the bottom edge hole of the faceplate attached to the bottom edge hole of the wall plate; the faceplate mounted into the recessed portion of the wall plate;

(c) a bezel having an opening, a front surface, a back surface, and struts vertically protruding from the back surface of the bezel, the front surface having a plurality of protrusions on its perimeter engaged in the front surface grooves in the recessed portion of the wall plate, the back surface of the bezel having a plurality of protrusions on its perimeter engaged in the back surface grooves in the wall plate, the protrusions and grooves forming a snap-fit coupling between the bezel and the wall plate.

(d) a reflector having an opening, vertically protruding legs, vertically extending rib protrusions on the inner wall of the reflector, a rim, and sockets on the outer periphery of the reflector for receiving the bezel struts, wherein the bezel struts are snap-fit coupled to the reflector sockets;

(e) a lens having a base and a body attached to the base, wherein the body of the lens is engaged to the reflector rib protrusions securing the lens to the reflector, the lens body extending through the bezel opening, the faceplate opening, and the reflector opening; and the lens base fastened by rim of the reflector; and (f) a printed circuit board having openings and superluminescent diodes for illuminating the lens, wherein the circuit board openings are snap-fit coupled to the reflector legs.

10. The hall fixture assembly according to claim 9, wherein the faceplate opening, the bezel opening, and the lens body are shaped in an up-arrow direction to show the movement of the elevator.

11. The hall fixture assembly according to claim 9, wherein the faceplate opening, the bezel opening, and the lens body are shaped in a down-arrow direction to show the movement of the elevator.

12. The hall fixture assembly according to claim 9, wherein the wall plate is vertically mounted to the electrical wall box.

13. The hall fixture assembly according to claim 9, wherein the wall plate is horizontally mounted to the electrical wall box.

14. A snap-fit constructible elevator hall fixture assembly comprising:

(a) a wall plate having a hole in its top edge and a hole in its bottom edge for attaching the wall plate to an electrical wall box; the wall plate having a front surface, a back surface, and a recessed portion on the front surface, the recessed portion having an opening; the perimeter of the opening on the front surface having a plurality of grooves, and the perimeter of the opening on the back surface having a plurality of grooves;

(b) a decorative faceplate having a faceplate opening, a hole in the top edge, of the faceplate, and a hole in the bottom edge of the faceplate; the top edge hole of the faceplate attached to the top edge, hole of the wall plate, and the bottom edge hole of the faceplate attached to the bottom edge hole of the wall plate; the faceplate mounted into the recessed portion of the wall plate;

(c) a bezel having an opening, a front surface, and a back surface, the front surface having a plurality of protrusions on its perimeter, the front surface protrusions engaged in the front surface grooves in the recessed portion of the wall plate, the back surface of the bezel having a plurality of protrusions on its perimeter, the bezel back surface protrusions engaged in the back surface grooves in the recessed portion of the wall plate, the protrusions and grooves forming a snap-fit coupling between the bezel and the wall plate;

(d) a push button having a body, struts extending from the body, a shoulder, and threads on the outer periphery of the body extending around the circumference of the body; the push button extending through the bezel opening and the faceplate opening, the shoulder abutting a portion of the faceplate surrounding the faceplate opening;

(e) a locking nut having threads on its inner periphery, the threads on the locking nut twist-coupled to the threads on the push button threads, the nut abutting a portion of the back surface of the bezel; and (f) an electrical switch device having slots, an activation switch, and a light emitting diode; the slots are snap-fit coupled to the struts of the push button, the activation switch is activated when the push button is pressed onto the activation switch, and the light emitting diode illuminates the push button when the activation switch is pressed.

15. The hall fixture assembly according to claim 14, wherein the wall plate is vertically mounted to the electrical wall box.

16. The hall fixture assembly according to claim 14, wherein the wall plate is horizontally mounted to the electrical wall box.

17. The hall fixture assembly according to claim 14, further comprising:

(a) an emergency-service faceplate having an opening and a hole in its top edge, the top edge hole of the emergency-service faceplate is attached to the top edge hole of the decorative faceplate;

(b) a printed circuit board bezel having an opening, a front surface, a back surface, and struts vertically protruding from the back surface of the bezel, the front surface having a plurality of protrusions on its perimeter snap-fit coupled to the front surface grooves in the recessed portion of the wall plate, the back surface of the circuit board bezel having a plurality of protrusions on its perimeter snap-fit coupled to the back surface grooves in the wall plate;

(c) a key-switch having a body and a shoulder, the body extending through a bezel opening, a decorative faceplate opening, and the emergency-faceplate opening, the shoulder abutting a portion of the emergency-faceplate surrounding the emergency-faceplate opening;

(d) a switch nut twist-coupled to the key-switch; and (e) a printed circuit board having openings and superluminescent diodes for illuminating the emergency-service faceplate, wherein the circuit board openings are snap-fit coupled to the struts on the circuit board bezel.

18. A snap-fit constructible elevator hall fixture assembly comprising:

(a) a wall plate having a hole in its top edge and a hole in its bottom edge for attaching the wall plate to an electrical wall box; the wall plate having a front surface, a back surface, and a recessed portion on the front surface, the recessed portion having an opening; the perimeter of the opening on the front surface having a plurality of grooves, and the perimeter of the opening on the back surface having a plurality of grooves;

(b) a decorative faceplate having a faceplate opening, a hole in the top edge of the faceplate, and a hole in the bottom edge of the faceplate; the top edge hole of the faceplate for attaching to the top edge hole of the wall plate, and the bottom edge hole of the faceplate for attaching to the bottom edge hole of the wall plate; the faceplate to be mounted into the recessed portion of the wall plate;

(c) a bezel having an opening, a front surface, a back surface, and struts vertically protruding from the back surface of the bezel, the front and back surfaces of the bezel having a plurality of protrusions on the perimeter of bezel to form a snap-fit couple between the bezel and the wall plate, the protrusions on the front surface of the bezel for engaging the front surface grooves in the recessed portion of the wall plate, the protrusions on the back surface of the bezel for engaging the back surface grooves in the wall plate;

(d) a reflector having an opening, vertically protruding legs, vertically extending rib protrusions on the inner wall of the reflector, a rim, and sockets on the outer periphery of the reflector for receiving the bezel struts, wherein the bezel struts are for snap-fit coupling to the reflector sockets;

(e) a lens having a base and a body attached to the base, wherein the body of the lens is to be engaged to the reflector rib protrusions to secure the lens to the reflector, the lens body is to be extended through the bezel opening, the faceplate opening, and the reflector opening, and the lens base to be fastened by rim of the reflector; and (f) a printed circuit board having openings and superluminescent diodes for illuminating the lens, wherein the circuit board openings are for snap-fit coupling to the reflector legs.

19. The hall fixture assembly according to claim 18, wherein the faceplate opening, the bezel opening, and the lens body are shaped in an up-arrow direction to show the movement of the elevator.

20. The hall fixture assembly according to claim 18, wherein the faceplate opening, the bezel opening, and the lens body are shaped in an down-arrow direction to show the movement of the elevator.

21. The hall fixture assembly according to claim 18, wherein the wall plate is to be vertically mounted to the electrical wall box.

22. The hall fixture assembly according to claim 18, wherein the wall plate is to be horizontally mounted to the electrical wall box.

23. A snap-fit constructible elevator hall fixture assembly comprising:

(a) a wall plate having a hole in its top edge and a hole in its bottom edge for attaching the wall plate to an electrical wall box; the wall plate having a front surface, a back surface, and a recessed portion on the front surface, the recessed portion having an opening; the perimeter of the opening on the front surface having a plurality of grooves, and the perimeter of the opening on the back surface having a plurality of grooves;

(b) a decorative faceplate having a faceplate opening, a hole in the top edge of the faceplate, and a hole in the bottom edge of the faceplate;

the top edge hole of the faceplate for attaching to the top edge hole of the wall plate, and the bottom edge hole of the faceplate for attaching to the bottom edge hole of the wall plate; the faceplate to be mounted into the recessed portion of the wall plate;

(c) a bezel having an opening, a front surface, and a back surface, the front and back surfaces of the bezel having a plurality of protrusions on the perimeter of bezel to form a snap-fit couple between the bezel and the wall plate, the protrusions on the front surface of the bezel for engaging the front surface grooves in the recessed portion of the wall plate, the protrusions on the back surface of the bezel for engaging the back surface grooves in the wall plate;

(d) a push button having a body, struts extending from the body, a shoulder, and threads on the outer periphery of the body extending around the circumference of the body; the push button to be extended through the bezel opening and the faceplate opening, the shoulder to abut a portion of the faceplate surrounding the faceplate opening;

(e) a locking nut having threads on its inner periphery, the threads on the locking nut to be twist-coupled to the threads on the push button threads, the nut to abut a portion of the back surface of the bezel; and (f) an electrical switch device having slots, an activation switch, and a light emitting diode; the slots for snap-fit coupling to the struts of the push button, the activation switch to be activated when the push button is pressed onto the activation switch, and the light emitting diode to illuminate the push button when the activation switch is pressed.

24. The hall fixture assembly according to claim 23, further comprising:

(a) an emergency-service faceplate having an opening and a hole in its top edge, the top edge hole of the emergency-service faceplate for attaching to the top edge hole of the decorative faceplate;

(b) a printed circuit board bezel having an opening, a front surface, a back surface, and struts vertically protruding from the back surface of the bezel, the front surface having a plurality of protrusions on its perimeter for snap-fit coupling to the front surface grooves in the recessed portion of the wall plate, the back surface of the circuit board bezel having a plurality of protrusions on its perimeter for snap-fit coupling to the back surface grooves in the wall plate;

(c) a key-switch having a body and a shoulder, the body to be extended through a bezel opening, a decorative faceplate opening, and the emergency-faceplate opening, the shoulder to abut a portion of the emergency-faceplate surrounding the emergency-faceplate opening;

(d) a switch nut for twist-coupling to the key-switch; and (e) a printed circuit board having openings and superluminescent diodes for illuminating the emergency-service faceplate, wherein the circuit board openings are for snap-fit coupling to the struts on the circuit board bezel.

25. The hall fixture assembly according to claim 23, wherein the wall plate is to be vertically mounted to the electrical wall box.

26. The hall fixture assembly according to claim 23, wherein the wall plate is to be horizontally mounted to the electrical wall box.

* * * * *